United States Patent [19]

Grant, Jr.

[11] Patent Number: 4,989,407

[45] Date of Patent: Feb. 5, 1991

[54] THRUST AUGMENTOR FLAMEHOLDER

[75] Inventor: James R. Grant, Jr., Jupiter, Fla.

[73] Assignee: United Technologies Corporation, Hartford, Conn.

[21] Appl. No.: 902,373

[22] Filed: Aug. 29, 1986

[51] Int. Cl.[5] ..... F02G 1/00

[52] U.S. Cl. ..... 60/261; 60/749; 60/757; 60/759

[58] Field of Search ..... 60/261, 749, 755, 757, 60/759

[56] References Cited

U.S. PATENT DOCUMENTS

| | | | |
|---|---|---|---|
| 3,633,362 | 1/1972 | Sotheran et al. | 60/261 |
| 3,656,297 | 4/1972 | Monk | 60/755 |
| 3,698,186 | 10/1972 | Beane et al. | 60/261 |
| 4,132,066 | 1/1979 | Austin, Jr. et al. | 60/752 |
| 4,315,401 | 2/1982 | Beal et al. | 60/261 |
| 4,423,595 | 1/1984 | McLean | 60/749 |
| 4,622,821 | 11/1986 | Madden | 60/757 |

*Primary Examiner*—Leonard E. Smith
*Assistant Examiner*—T. S. Thorpe
*Attorney, Agent, or Firm*—Troxell K. Snyder

[57] ABSTRACT

A radial flameholder (18) extends from the augmentor case (22) through an opening (30) in a coaxial liner (20) and into the hot exhaust gas stream (26). A portion of a cool, annular fan air stream (28) enters an upstream facing opening (34) and discharged radially inwardly adjacent the downstream edge (44) of the liner opening (30). The inner flow (42) of cool air protects the liner (20) downstream of the flameholder (18) by both cooling the liner (20) locally and by displacing the combustion reaction (32) attached to the flameholder (18).

1 Claim, 2 Drawing Sheets

THRUST AUGMENTOR FLAMEHOLDER

FIELD OF THE INVENTION

The present invention relates to a flameholder for a thrust augmentor in a gas turbine engine arrangement.

BACKGROUND

Modern gas turbine engine augmentors operating at high exhaust gas inlet temperatures require that any hardware placed in the engine exhaust gas stream, specifically the augmentor fuel injectors and flameholders, be cooled to maintain the temperature of the hardware at a level compatible with the materials used. This requirement has resulted in prior art augmentor designs wherein individual fuel injector spraybars and flameholders are mounted about the circumference of the augmentor case and extend radially inward therefrom into the hot engine exhaust gas stream. Such an arrangement allows the individual structures to be cooled by the relatively low temperature fan air which typically flows in an annulus located adjacent the augmentor case and separated from the coaxial engine exhaust gas stream by an inner screech liner or similar barrier.

Such radial designs, while effective in cooling the spraybar or flameholder structures themselves, results in the establishment of active combustion immediately adjacent the inner surface of the augmentor liner downstream of the individual radial flameholders. The result of such combustion is a localized area of overtemperature in the liner, often termed a "hot spot" or "hot streak" which in turn causes localized conditions of thermal stress, premature wear, and a generally undesirable reduction in the liner service lifetime.

Prior art liner cooling solutions, such as distributing cooling holes over the liner to provide a transpiration cooling film by drawing the relatively cool fan air into the engine exhaust gas stream adjacent the inner liner, have not been adequately effective in the high heat release flame zone immediately downstream of the flameholder structure. The local liner overtemperature problem is identical whether the fuel injector and flameholder structures are distinct or combined.

What is needed is an effective means for locally protecting the augmentor liner immediately downstream of a radial flameholding structure.

SUMMARY OF THE INVENTION

It is therefore an object of the present invention to provide a radial flameholder structure for a thrust augmentor in a gas turbine engine arrangement.

It is further an object of the present invention to provide a radial flameholder structure which avoids hot streaking of the downstream augmentor liner.

It is further an object of the present invention to avoid such hot streaking by providing a means for cooling the liner immediately downstream of the flameholder structure.

It is further an object of the present invention to vary the cooling capacity of the liner cooling means responsive to the average liner temperature.

It is still further an object of the present invention to accomplish the foregoing objects passively, without resort to any active operator control influence.

According to the present invention, a radial flameholder structure is provided in the configuration of an elongated bluff body attached to the outer casing of a gas turbine engine thrust augmentor and extending radially into the engine exhaust gas flow through an opening in a concentric inner augmentor liner. The bluff body is cooled internally by a flow of cooling air diverted into the flameholder structure from the annular flow of relatively cool air passing between the liner and the augmentor case. The internally flowing cooling air is directed through the bluff body and discharged into the engine exhaust gas stream.

The flameholder structure according to the present invention avoids creating a localized hot spot or streak in the liner downstream of the bluff body by ingesting an additional portion of the annularly flowing, relatively cool air through an upstream facing opening in the flameholder and discharging it radially inward and adjacent the liner downstream of the bluff body. The cooling air thus discharged prevents hot streaking by both directly cooling the liner inner surface and by locally displacing the combusting exhaust gases, thereby preventing their direct contact with the liner surface.

The flameholder structure of the present invention further provides the feature of temperature responsiveness by positioning the liner radially intermediate the corresponding cooling air discharge opening for dividing the discharged cooling gas between a radially inner flow and a radially outer flow, each flow being respectively adjacent the liner inner and outer surfaces. By further allowing the liner to expand radially in response to its average material temperature, the present invention provides a flameholder configuration wherein the proportional split between the inner and outer cooling gas flow is increased in favor of the inner flow as the liner temperature rises, thereby increasing the cooling protection of the liner inner surface.

Both these and other objects and advantages of the flameholder structure of the present invention will be apparent to those skilled in the art after a review of the following description and the appended claims and drawing figures.

DETAILED DESCRIPTION OF THE PREFERRED EMBODIMENT

Figure 1:
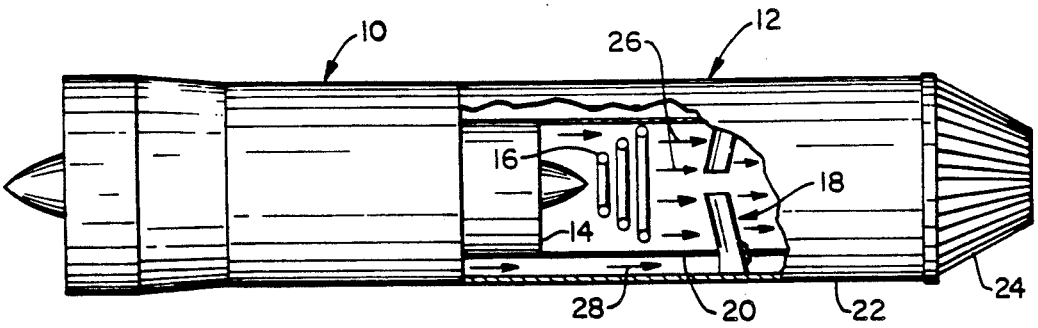
FIG. 1 shows a general arrangement of a gas turbine engine and a thrust augmentor having separate augmentor fuel injector and flameholder structure.

FIG. 1 shows a general arrangement of a turbofan gas turbine engine 10 and a thrust augmentor 12 disposed downstream thereof. The augmentor 12 functions by receiving a stream 26 of hot exhaust gas from the core engine outlet 14, injecting a quantity of typically liquid fuel into the discharged exhaust gas stream through a fuel injector-spraybar structure 16, and combusting the fuel-exhaust gas mixture downstream of a flameholder structure 18 which provides the necessary turbulence and gas recirculation for achieving a stable combustion flamefront.

In the turbofan arrangement shown in FIG. 1, the exhaust gas stream is surrounded by a stream of relatively low temperature fan air 28 which is separated from the core engine exhaust gas stream 26 by an inner augmentor liner 20 disposed coaxially within the augmentor outer case 22. The exhaust gas stream 26, heated by the combustion reaction, is finally discharged from the augmentor via a variable area nozzle 24.

As discussed in the preceding Background section, the high temperature exhaust gas stream of a modern gas turbine engine has induced designers of prior art thrust augmentors to provide radially oriented, elongated structures in order to take advantage of the relatively cool, annularly flowing fan air stream as a source of internal cooling. Such radial structures, unlike annular flameholder designs, result in the formation of a zone of combustion located immediately downstream of the radial structure and adjacent the inner surface of the liner 20.

Figure 2:
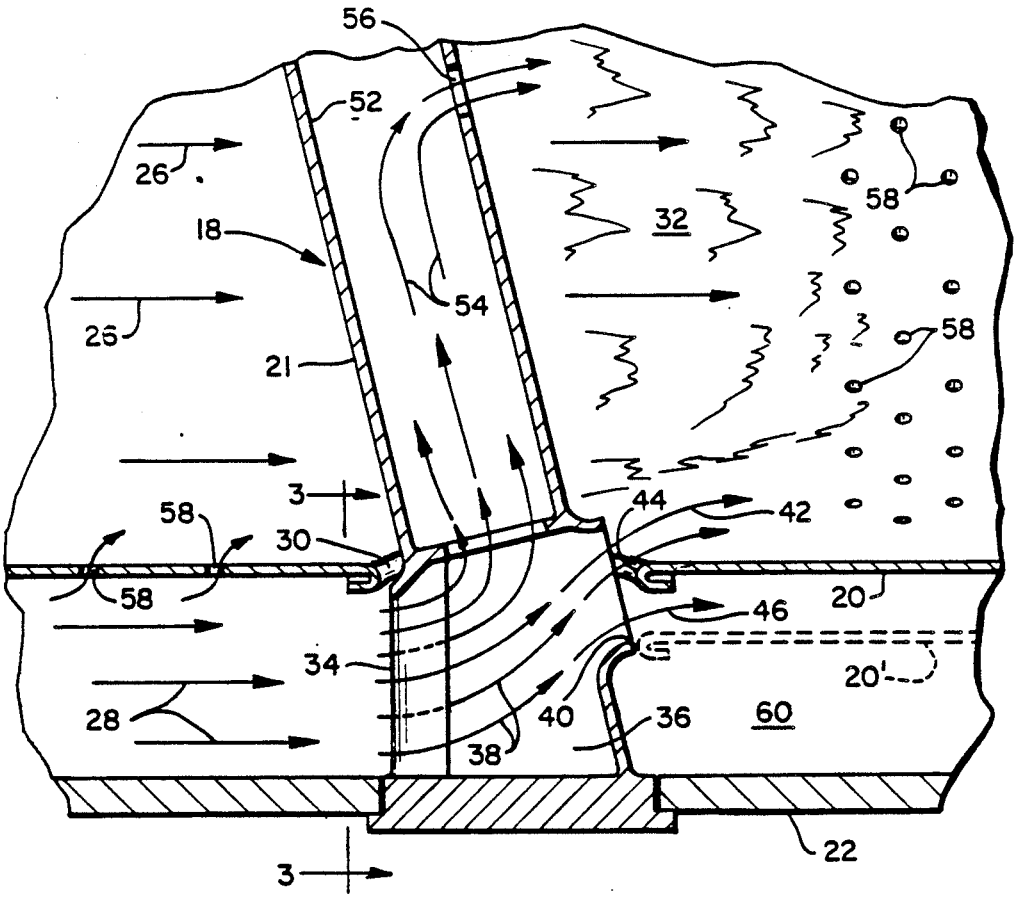
FIG. 2 is a closer view of a radial flameholder structure in the vicinity of the augmentor case and inner liner.

The flameholder structure according to the present invention avoids the aforementioned deleterious effects of such hot streaking as shown more clearly in FIG. 2 which is a more detailed view of the radially outer end of the flameholder structure 18.

As can be seen in FIG. 2, the hot core engine exhaust gas stream 26 is divided from the relatively cool, low pressure annular fan air stream 28 by the augmentor inner liner 20. The radial flameholder 18 is an elongated bluff body secured at its radially outer end to the cylindrical augmentor case 22 and passing into the exhaust gas stream 26 through an opening 30 in the liner 20. A combustion reaction 32 is shown attached to the downstream side of the flameholder 18 which creates the necessary gas recirculation and ignition environment required to stabilize the augmentor flame and which is well known in the art.

The flameholder structure 18 includes an upstream facing opening 34 disposed in the radially outer end of the flameholder structure 18 for ingesting a portion of the annularly flowing stream of relatively cool fan air 28. An internal plenum 36 in the flameholder structure 18 directs the ingested air 38 radially inward whence it is discharged through a downstream facing opening 40. The downstream facing opening 40 is radially positioned with respect to the liner 20 for causing at least a portion 42 of the ingested air 38 to be discharged radially inwardly adjacent the liner 20. The inwardly discharged cool air 42 displaces the reacting exhaust gas and fuel mixture 32 from the inner surface of the liner 20 and thereby prevents localized overheating or hot streaking.

As shown in FIG. 2, the downstream edge 44 of the liner opening 30 also divides the discharged air into an outer cooling flow 46 which moves radially outwardly adjacent the liner 20. It is a feature of the flameholder structure according to the present invention that the liner 20 is radially expandable responsive to the average material temperature and thermal coefficient of expansion. Such expansion due to increased average liner material temperature results in a decrease in the annular spacing between the liner 20 and the augmentor case 22 as shown by the broken outline 20'. The variation of the liner radius causes a displacement of the downstream edge 44 relative to the discharge opening 40, resulting in a variation of the proportion of the discharge split between the inner flow 42 and the outer flow 46.

As can be seen in FIG. 2, the expanded liner 20' is positioned so as to result all of the air flow from opening 40 being discharged inwardly radially adjacent the downstream surface of the liner 20, thus providing the maximum cooling benefit to this critical area. This variation of the proportional split between the inner and outer flows 42, 46 is thus achieved by a passively responsive cooling arrangement wherein the quantity of relatively cool fan air 28 diverted from between the liner 20 and case 22 into the exhaust gas stream 26 varies in proportion to the average liner material temperature and hence the need of such liner material for localized thermal protection. The combusting mixture 32 is therefore displaced radially inward and diluted only as necessary to avoid damage to the liner surface downstream of the flameholder 18.

FIG. 2 also shows a portion 54 of the ingested cooling air 38 diverted longitudinally inward through an internal flow passage 52 disposed within the elongated bluff body 21 of the structure 18. The internal cooling air 54 cools and protects the body 21 which is subject to contact with the high temperature exhaust gas 26, eventually being discharged from openings 56 disposed in the bluff body 21, or the like. Having completed its cooling duties, this internal air flow 54 is discharged in the FIG. 2 embodiment through an opening 56 or other means.

Figure 3:
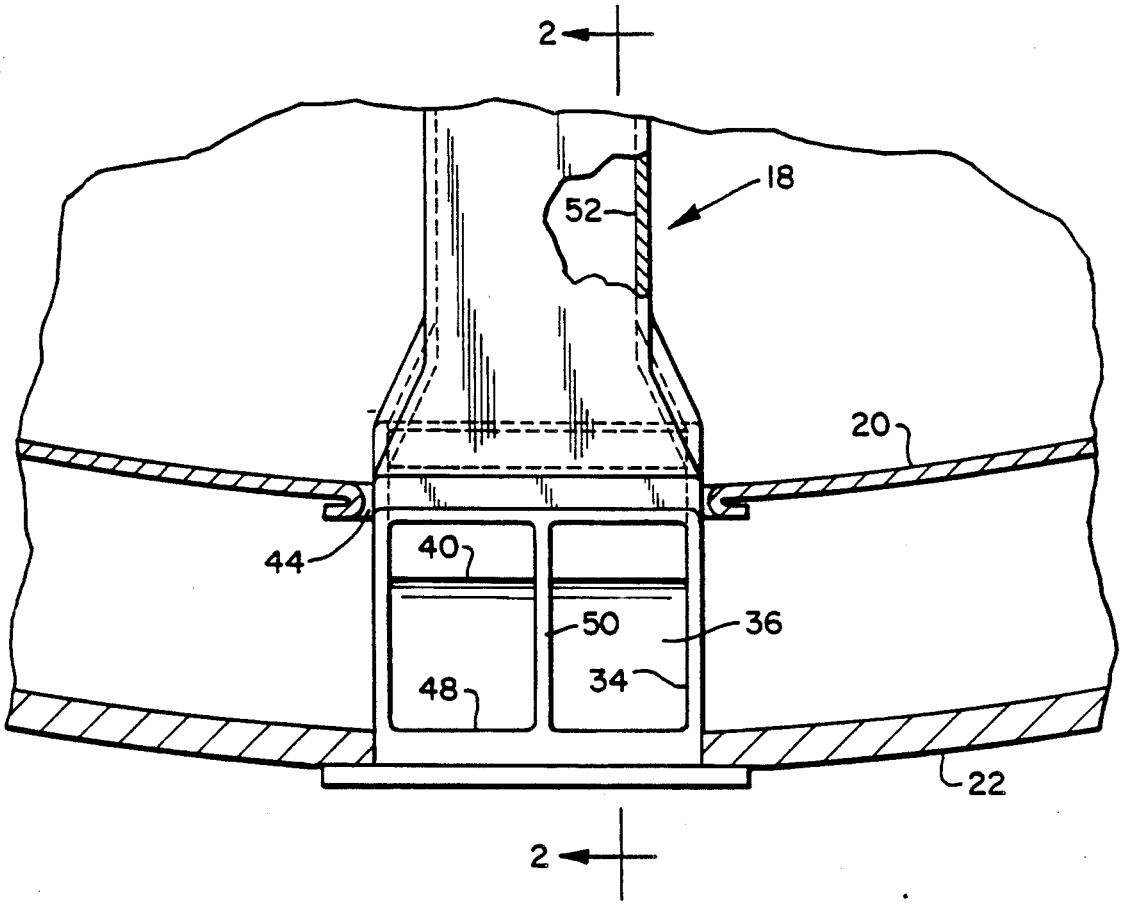
FIG. 3 is a view of the flameholder structure as indicated in FIG. 2.

FIG. 3 shows a view of the structure 18 looking downstream into the forward facing opening 34. The liner 20, discharge opening 40 and the downstream liner edge are shown as viewed through the plenum 36. The bluff body internal flow passage 52 opens into the plenum 36 for diverting a portion of the ingested cooling air 38 as described above. The FIG. 3 arrangement also includes a septum 50 dividing the forward facing opening into two openings 34, 48 which both open into the plenum 36. The septum 50 provides structural strength for the radially outward portion of the flameholder structure 18.

It is also within the scope of the present invention to restrict or apportion the flow of air ingested by the structure 18 by sizing the internal flow passage 52, the discharge opening 40, and/or the forward facing opening(s) 34, 48. Another arrangement (not shown) provides for separating the bluff body cooling air 54 and the liner cooling air 42, 46 within the structure 18 by continuing the septum 50 and separately channeling the airflows to their corresponding duties.

The above described embodiment of the flameholder according to the present invention is thus well adapted to achieve the objects and advantages set forth hereinabove. It will further be appreciated that the flameholder structure of the present invention is also well suited to function as a combined flameholder-fuel injector when provided with a fuel delivery means (not shown) and a plurality of fuel discharge openings disposed along the bluff body portion 21. In such combined configuration, the internal cooling air 54 serves to both cool the bluff body as well as any internal fuel conduits while the downstream surface of the liner 20 is protected from the attached combustion zone 32 by the inner cooling airflow 42.

One final advantage of the flameholder according to the present invention results from the increased thermal protection provided for the liner 20 by the inner flow 42. As discussed in the preceding Background section, it is common in the prior art to provide a plurality of transpiration cooling holes 58 in the liner 20 for establishing a cooling film (not shown) adjacent the radially inner surface of the liner 20. Such cooling holes are not required in the liner immediately downstream of the structure 18 due to the local cooling effect of the inner flow 42. Moreover, the elimination of such prior art transpiration cooling holes 58 in this downstream location avoids any possibility of hot exhaust gases passing through the liner 20 and into the annulus 60 as a result of the gas turbulence generated downstream of the flameholder structure 18.

The present invention thus provides a passive flameholder structure 18 which avoids creation of hot streaks or other localized overtemperature conditions in a radial flameholder arrangement in a gas turbine engine augmentor. It will be appreciated by those skilled in the art that a variety of different flameholder and combined flameholder-fuel injector structures can be constructed without departing from the scope of the invention as illustratively described hereinabove, and that such description should therefore not be taken in a limiting sense.

I claim:

1. A radial flameholder for a gas turbine engine thrust augmentor having a cylindrical outer case and a concentric inner liner, the inner liner defining means for conducting a stream of engine exhaust gases axially through the augmentor, said exhaust gases being mixed with fuel and combusted immediately downstream of said flameholder, and the outer case and the inner liner cooperatively defining an annular flow path therebetween and means for concentrically conducting a concurrent flow of relatively cool air therethrough, comprising:

a bluff body secured to the outer case and extending radially inward therefrom through a corresponding opening in the inner liner, the bluff body further including, means, including a first upstream facing opening disposed wholly within the annular flow path, for ingesting a first portion of the relatively cool air flow, and means, including a downstream facing discharge opening, for exhausting a first inner part of the first portion of the relatively cool air radially inwardly adjacent and parallel to the liner immediately downstream of the opening therein, and a second outer part of the first portion of the relatively cool air radially outwardly adjacent and parallel to the liner immediately downstream of the opening therein, said first inner part and said second outer part being divided radially by the liner, and wherein the liner is expandable radially outward adjacent the bluff body in response to increasing temperature of the liner material, thereby increasing the portion of the first inner part of the discharged first portion relative to the second outer part thereof.

* * * * *